US006820763B2

(12) United States Patent
Bilskie et al.

(10) Patent No.: US 6,820,763 B2
(45) Date of Patent: Nov. 23, 2004

(54) PORTABLE BEVERAGE DISPENSING SYSTEMS

(75) Inventors: Richard P. Bilskie, Newnan, GA (US); Harold F. Stover, Grantville, GA (US)

(73) Assignee: SB Partnership, Inc., Newnan, GA (US)

( * ) Notice: Subject to any disclaimer, the term of this patent is extended or adjusted under 35 U.S.C. 154(b) by 106 days.

(21) Appl. No.: 10/098,025

(22) Filed: Mar. 13, 2002

(65) Prior Publication Data

US 2003/0173376 A1 Sep. 18, 2003

(51) Int. Cl.[7] ..... B67D 5/08; B67D 5/56

(52) U.S. Cl. ..... 222/61; 222/105; 222/129.1; 222/325; 222/400.7

(58) Field of Search ..... 222/52, 61, 62, 222/105, 129.1, 129.2, 325, 400.7, 464.1

(56) References Cited

U.S. PATENT DOCUMENTS 3,878,970 A * 4/1975 Nezworski ..... 222/61
4,265,374 A * 5/1981 Sebalos ..... 222/95
5,199,609 A * 4/1993 Ash, Jr. ..... 222/94
5,240,144 A * 8/1993 Feldman ..... 222/82
5,253,960 A 10/1993 Scott ..... 405/302.2
5,411,179 A 5/1995 Oyler et al. ..... 222/129.1
5,529,220 A * 6/1996 Credle et al. ..... 222/175
5,553,749 A 9/1996 Oyler et al. ..... 222/129.1
5,957,328 A * 9/1999 Osgar ..... 222/1
6,021,922 A * 2/2000 Bilskie et al. ..... 222/67
6,216,913 B1 * 4/2001 Bilskie et al. ..... 222/67
6,234,349 B1 5/2001 Bilskie et al. ..... 222/67
6,253,960 B1 * 7/2001 Bilskie et al. ..... 222/67
6,536,632 B2 3/2003 Bilskie et al. ..... 222/400.7

* cited by examiner

*Primary Examiner*—Gene Mancene
*Assistant Examiner*—Patrick Buechner
(74) *Attorney, Agent, or Firm*—Thomas, Kayden, Horstemeyer & Risley, LLP

(57) ABSTRACT

The present disclosure relates to a beverage dispensing system. In one arrangement, the beverage dispensing system comprises a self-contained, removable container unit, the container unit including at least one liquid container that is adapted to store a liquid therein, and a source of gas under pressure that provides a driving mechanism for delivering liquid from the at least one liquid container of the removable container unit. In addition, the present disclosure relates to liquid containers for beverage dispensing systems.

34 Claims, 10 Drawing Sheets

PORTABLE BEVERAGE DISPENSING SYSTEMS

FIELD OF THE INVENTION

The present invention relates beverage dispensing. More particularly, the present invention relates to portable beverage dispensing systems.

BACKGROUND OF THE INVENTION

Portable beverage dispensing systems have been produced that facilitate the dispensing of various beverages at locations other than stationary fountain stations such as bars. For instance, several such beverage dispensing systems have been described in assignee's U.S. Pat. Nos. 5,253,960, 5,411,179, 5,553,749, 6,021,922, 6,216,913, 6,234,349.

Such beverage systems utilize pressurized gas (e.g., carbon dioxide ($CO_2$)) as both a fluid driving mechanism and as means to carbonate water for carbonated drinks such as soft drinks. With such systems, carbonated and other drinks can be supplied to persons in remote locations through use of an appropriate delivery vehicle. For instance, the portable beverage dispensing systems can be provided within push carts and used on passenger craft such as airplanes and trains. Similarly, the systems can be provided in electric or gas-powered carts commonly used on golf courses.

Despite the convenience provided by of these beverage dispensing systems, impediments to their wide-spread implementation exist. Perhaps the most significant of these impediments relates to the containers that are used within the systems to store the various liquids that are to be dispensed. Generally speaking, the beverage dispensing systems use specially-designed, relatively low volume containers for soft drink syrups, juice concentrates, and the other stored liquids due to space constraints of the delivery vehicles (e.g., carts) in which the systems are installed. Although some beverage producers have filled such special containers for the beverage dispensing systems, there has been resistance from some producers in that it is more inconvenient, and more expensive, to fill non-standard containers. Instead, such producers much prefer filling widely-used containers for which they already have existing filling machines. One example is soft drink producers who typically fill 2.5 or 5 gallon bag-in-box (BIB) containers for fountain drink applications.

Although attempts have been made to integrate standard containers, such as BIB containers, in portable beverage dispensing systems, this integration has created complications in terms of physically fitting the containers in the delivery vehicles, the increased weight of the delivery vehicle, and increased driving gas consumption.

From the above, it is apparent that it would be desirable to have a portable beverage system that is configured so as to permit utilization of standard containers, such as BIB containers.

SUMMARY OF THE INVENTION

The present disclosure relates to a beverage dispensing system. In one arrangement, the beverage dispensing system comprises a self-contained, removable container unit, the container unit including at least one liquid container that is adapted to store a liquid therein, and a source of gas under pressure that provides a driving mechanism for delivering liquid from the at least one liquid container of the removable container unit.

In addition, the present disclosure relates to liquid containers for beverage dispensing systems. In one arrangement, the liquid containers can comprise an exterior vessel that forms an interior space that is adapted to receive pressurized gas, a pliable bag that is adapted to be placed within interior space of the exterior vessel, and an adapter that is adapted to connect the pliable bag to the exterior vessel.

In another arrangement, the liquid containers can comprise a bottle that includes a body and a neck, and a bottle coupler that is adapted to connect to the bottle, the bottle coupler comprising a liquid passage through which liquid can travel into and out from the bottle and a gas passage through which pressurized air can pass into and out from the bottle.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

DETAILED DESCRIPTION

As noted above, it would be advantageous to have portable beverage dispensing systems that utilize standard liquid containers to obviate the need for beverage producers to fill non-standard containers. As is discussed in greater detail below, this goal can be achieved by designing the beverage dispensing system such that it uses the standard containers (e.g., BIB containers) as a liquid source for filling relatively smaller liquid containers that comprise part of the portable beverage dispensing system and which may be included within the applicable delivery vehicle (e.g. cart). With such an arrangement, beverages can be dispensed remotely from the location of the standard containers and, when one or more containers within the system become empty, the system can be replenished by returning to the location of the standard containers and simply refilling the containers.

Figure 1:
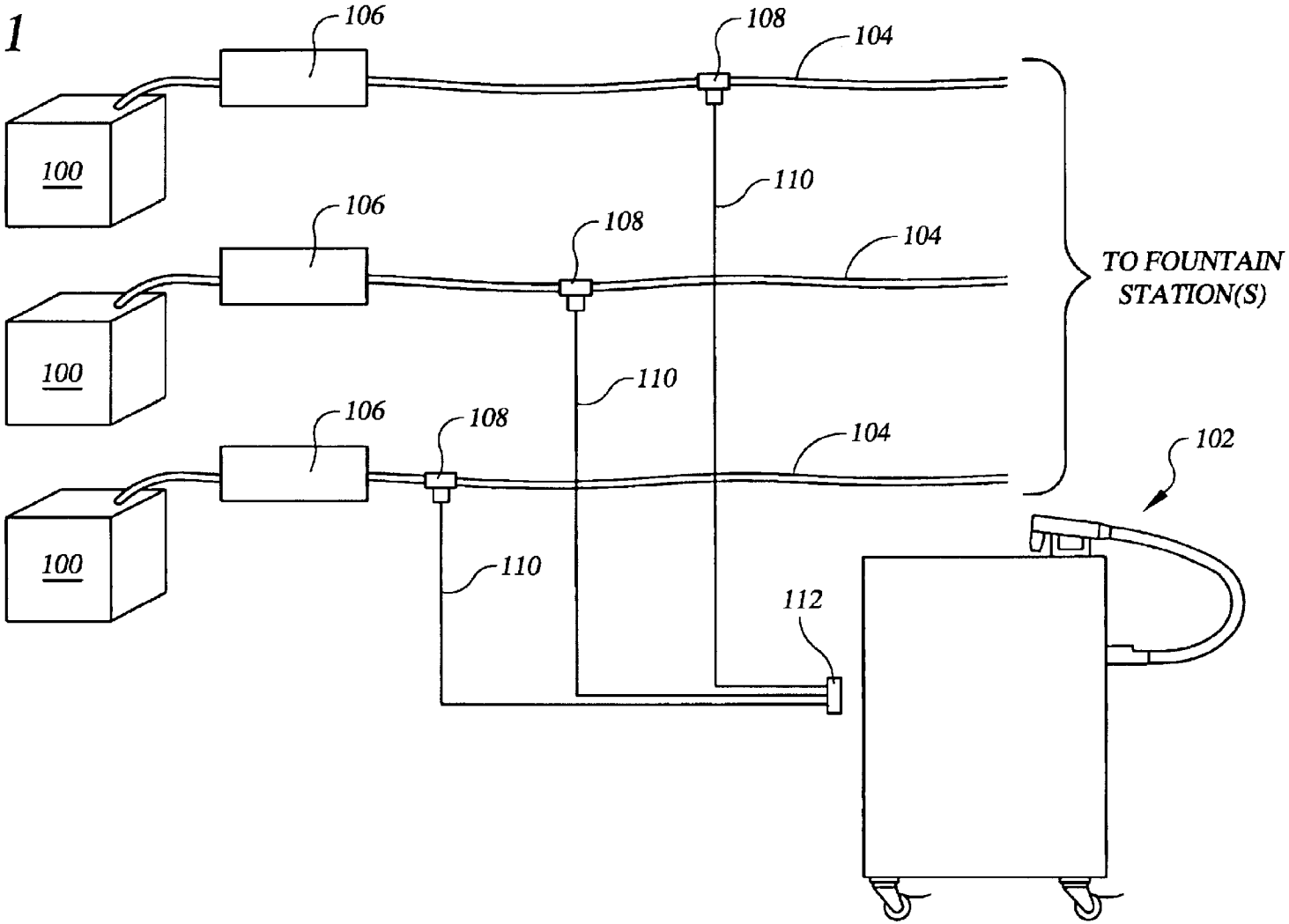
FIG. 1 is a schematic view of a filling scheme for filing portable beverage dispensing systems.

FIG. 1 illustrates an example filling scheme for portable beverage dispensing systems. As indicated in this figure, various different standard containers 100 can be used as liquid sources for a portable cart 102 that comprises a self-contained beverage dispensing system (not shown). Although a cart is explicitly identified herein, it will be appreciated that the beverage dispensing system could, alternatively, be moved from place-to-place with any other suitable delivery vehicle.

By way of example, each of the standard containers 100 can comprise bag-in-box (BIB) containers that store one or more types of liquids. Although BIB containers have been explicitly identified, persons having ordinary skill in the art will appreciate the containers 100 can take the form of substantially any liquid container. For instance, one or more of the containers 100 can, optionally, comprise a vessel for storing juice concentrates, beer, coffee, or other liquids. Moreover, although three such containers 100 are illustrated, it is to be understood that greater or fewer such containers could be used as liquid sources depending upon the configuration of the portable beverage dispensing system that is being filled.

Associated with each container 100 is a supply line 104 through which liquid contained within the container is supplied. By way of example, the supply lines 104 may be used to supply the liquids to one or more fountain stations located, for instance, at a bar. Associated with each supply line 104 is a liquid pump 106 that is used to draw liquid out of the containers 100.

In order to divert a portion of the flow of liquid passing through the supply lines 104 to the portable cart 102 (or other vehicle), valves 108 may be provided along the length of the supply lines to provide liquid to various filling lines 110 that can be used to replenish the portable beverage system contained within the cart. As indicated in FIG. 1, each of these filling lines 110 can, optionally, be connected to a quick-release coupler 112 that, as described below, facilitates coupling of each filling line to an appropriate line of the portable beverage dispensing system.

Figure 2:
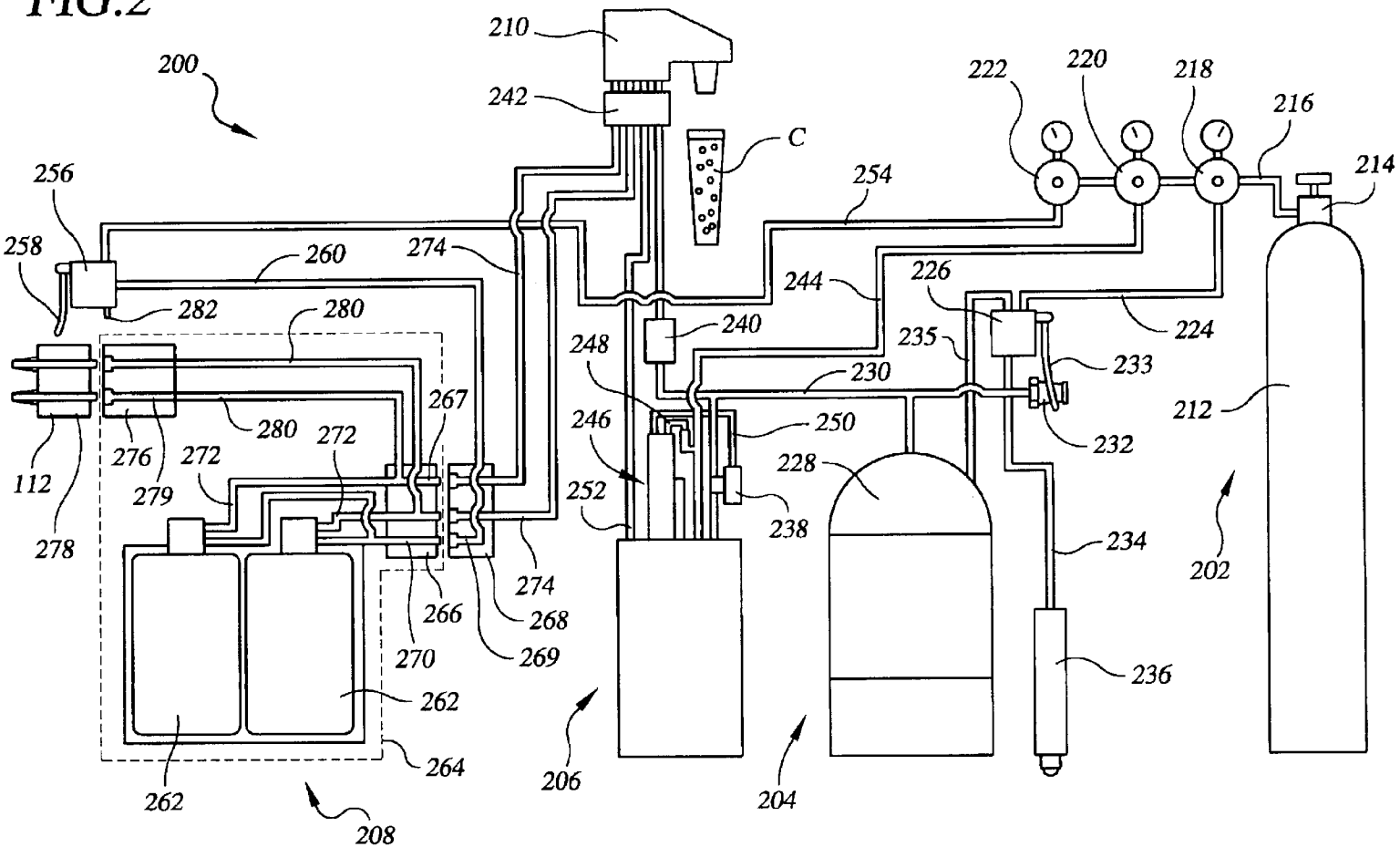
FIG. 2 is a schematic view of a first embodiment of a portable beverage dispensing system.

FIG. 2 illustrates a first embodiment of a portable beverage dispensing system 200 that can, for instance, be integrated into a suitable delivery vehicle such as the portable cart 102 shown in FIG. 1. The system 200 generally comprises a source 202 of driving gas, a source 204 of water, a carbonator tank 206, a source 208 of liquids, and a beverage dispensing valve 210.

The source 202 of driving gas typically comprises a refillable gas storage tank 212 that is filled with a pressurized gas, such as carbon dioxide ($CO_2$) gas. As is discussed in more detail below, the pressurized gas contained within the gas storage tank 212 is used for various purposes including carbonating water in the carbonator tank 206, pressurizing water to be supplied to the carbonator tank, and pressurizing various liquids stored in the source 208 of liquids to drive them through the system 200 to the dispensing valve 210.

The pressurized gas exits the gas storage tank 212 through a gas shut-off valve 214. When the gas shut-off valve 214 is open, pressurized gas travels through a gas outlet 216 and is supplied to one or more gas pressure regulators, for instance regulators 218, 220, and 222. In the arrangement shown in FIG. 2, the gas traveling through the first pressure regulator 218 is reduced in pressure, for instance to approximately 175 pounds per square inch (psi) to 250 psi, and then travels to a supply line 224, which delivers the gas to a gas supply valve 226, or other gas control, associated with the source 204 of pressurized water. By way of example, the source 204 of pressurized water comprises a high pressure water tank 228. Although capable of alternative configurations, this water tank 228 typically is constructed of a strong, corrosion-resistant metal such as stainless steel. Inside the water tank 228 is a bladder (not shown) that separates the interior of the water tank into two separate spaces, the first space within the bladder for storing water and the second space, outside of the bladder, for receiving gas that is used to pressurize and drive the water contained in the bladder.

In fluid communication with the internal bladder of the water tank 228 is a water supply line 230. Among its other functions, the water supply line 230 is used to refill the water tank 228. This is accomplished by connecting an appropriate water source to a refill inlet valve 232 of the water supply line 230. By way of example, the water source can comprise a source of purified water or a standard tap water source.

The gas supply valve 226 can include a lever 233 that is adjacent the refill inlet valve 232 and that is biased to an outward position. By way of example, the gas supply valve 226 can comprise a normally open, three-way valve that, in a normal or first position, provides gas flow into the water tank 228 (via supply line 235) to pressurize/drive the water contained within the tank and, in the tank refill or second position, shut off the flow of gas to the tank and vent the tank to the atmosphere through a vent line 234 that leads to a diffuser 236 that gradually diffuses the vented gas. When configured to operate in this manner, the gas supply valve 226 automatically reduces the pressure of the water tank 228 when an operator attempts to fill the tank via the refill inlet valve 232, as well as automatically repressurizes the water tank once the tank has been refilled.

In addition to facilitating filling of the water tank 228, the water supply line 230 further is used to transport pressurized water in two separate directions. In a first direction, the water is supplied to a carbonator fill water control valve 238 that controls the flow of water from the water tank 228 into the carbonator tank 206. Typically, the water control valve 238 is pneumatically actuated to open or close to thereby permit or prevent the flow of water therethrough. By way of example, the water control valve 228 comprises a normally closed, gas-actuated valve. Actuation of the water control valve 238 is described in greater detail below.

Water is also supplied via the water supply line 230 to the dispensing valve 210, which can, for instance, comprise a bar gun or bar tower. Normally, the pressure of the water is first reduced by a water pressure regulator 240. Before arriving at the dispensing valve 210, the water may flow through a cold plate 242 (where provided) that lowers the temperature of the water before it reaches an appropriate beverage container C.

Gas passing through the second pressure regulator 220 is reduced in pressure, for instance to approximately 80 psi to 125 psi, and is then delivered along a gas supply line 244 to the carbonator tank 206. In particular, the gas is delivered to the interior of the tank to carbonate the water stored therein and to a filling system 246 that is used to sense the fill condition of the carbonator tank and control filling based upon the sensed conditions. An example configuration for the filling system 246 is described in greater detail below in relation to FIGS. 3–5. Generally speaking, however, gas is supplied to the filling system 246 with a branch line 248 that powers a switch that, in response to the detected fill condition of the carbonator tank 206, signals the carbonator fill water control valve 238, via a signal line 250, to open or close. In this manner, the carbonator tank 206 will be periodically refilled as necessary so that an adequate amount of carbonated water will be available for deliver to the dispensing valve 210 via carbonated water supply line 252.

The pressurized gas that travels through the third gas pressure regulator 222 is reduced in pressure, for instance to approximately 10 psi to 50 psi, and is then delivered to gas supply line 254. As indicated in FIG. 2, this supply line 254 is in fluid communication with a gas supply valve 256 which, by way of example, can have a configuration similar to that of supply valve 226 described above. Accordingly, the gas supply valve 256 can be configured as a normally open, three-way valve whose operation is controlled by a lever 258. When open, (i.e., with the lever extended) the gas supply valve 256 delivers pressurized gas along a container supply line 260 that, as indicated in FIG. 2, delivers gas to one or more containers 262 of the source 208 of liquids that stores liquid(s) to be dispensed by the system 200.

In some arrangements, the source 208 of liquids can be arranged as a self-contained removable container unit (identified by dashed lines 264) such that the source can be removed from the system and replaced with a new source, if desired. By way of example, this container unit 264 can comprise a removable cell analogous to an automobile battery. The modularity provided by such a configuration allows for servicing and/or replacement of the containers 262 (an example of which described in relation to FIGS. 6–9). This removability/replaceability, and the refilling capabilities it provides, can be facilitated with mating supply couplers 266 and 268 that form part of the container unit 264 and the remainder of the system 200, respectively. Each supply coupler 266, 268 includes various ports 267, 269, respectively, for directing liquids supplied by the containers 262. In such an arrangement, the gas can be supplied to the various containers 262 with a gas supply line 270 that comprises a separate branch for each individual container of the unit 264. This gas acts as a driving mechanism to urge liquids contained within the containers 262 out through liquid supply lines 272 that, in turn, supply liquid to liquid supply lines 274 that are in fluid communication with the dispensing valve 210.

Filling of the source 208 of liquids can be facilitated with a quick-release coupler 276 of the removable container unit 264 that is adapted to, as indicated in FIG. 2, mate with the quick-release coupler 112 first identified in FIG. 1. As is illustrated in FIG. 2, both quick-release couplers 112, 276 can comprise ports 278 and 279, respectively, for each liquid filling line 280 of the container unit 264. With such an arrangement, the various containers 262 of the beverage dispensing system 200 can be filled simultaneously by first connecting the quick-release coupler 112 to the mating quick-release coupler 276 of the container unit 264 such that liquid will be provided through the various individual ports 278, 279 and fill lines 280. To ensure that the correct liquid is provided to the correct containers 262, the couplers 112 and 276 are typically configured such that mating is only possible in one predetermined relative orientation so that the correct ports 278 align with the correct ports 279. Configured in this manner, the liquid of a first container 100 (FIG. 1) will always be supplied to, for instance, a first container 262 (FIG. 2), and so forth.

During a filling operation, the lever 258 of the valve 256 is depressed by the quick-release coupler 112 (or other coupler) when it is coupled to the quick-release coupler 276. As with operation of the valve 226, depression of the lever 258 causes the flow of gas to the containers 262 to be shut off and permits the gas contained within the containers to be vented to the atmosphere via a vent line 282. Once the coupler 112 is detached from the coupler 276, however, gas flow to the containers 262 is resumed and the containers are repressurized.

Although the containers 262 have been described as being provided in a removable container unit, it is to be appreciated that such a configuration is not required and that the containers could, alternatively, be individually removable from the system 200, if desired. Furthermore, although two such containers 262 are illustrated, persons having ordinary skill in the art will appreciate that a fewer or a greater number of containers could be provided.

Figure 3:
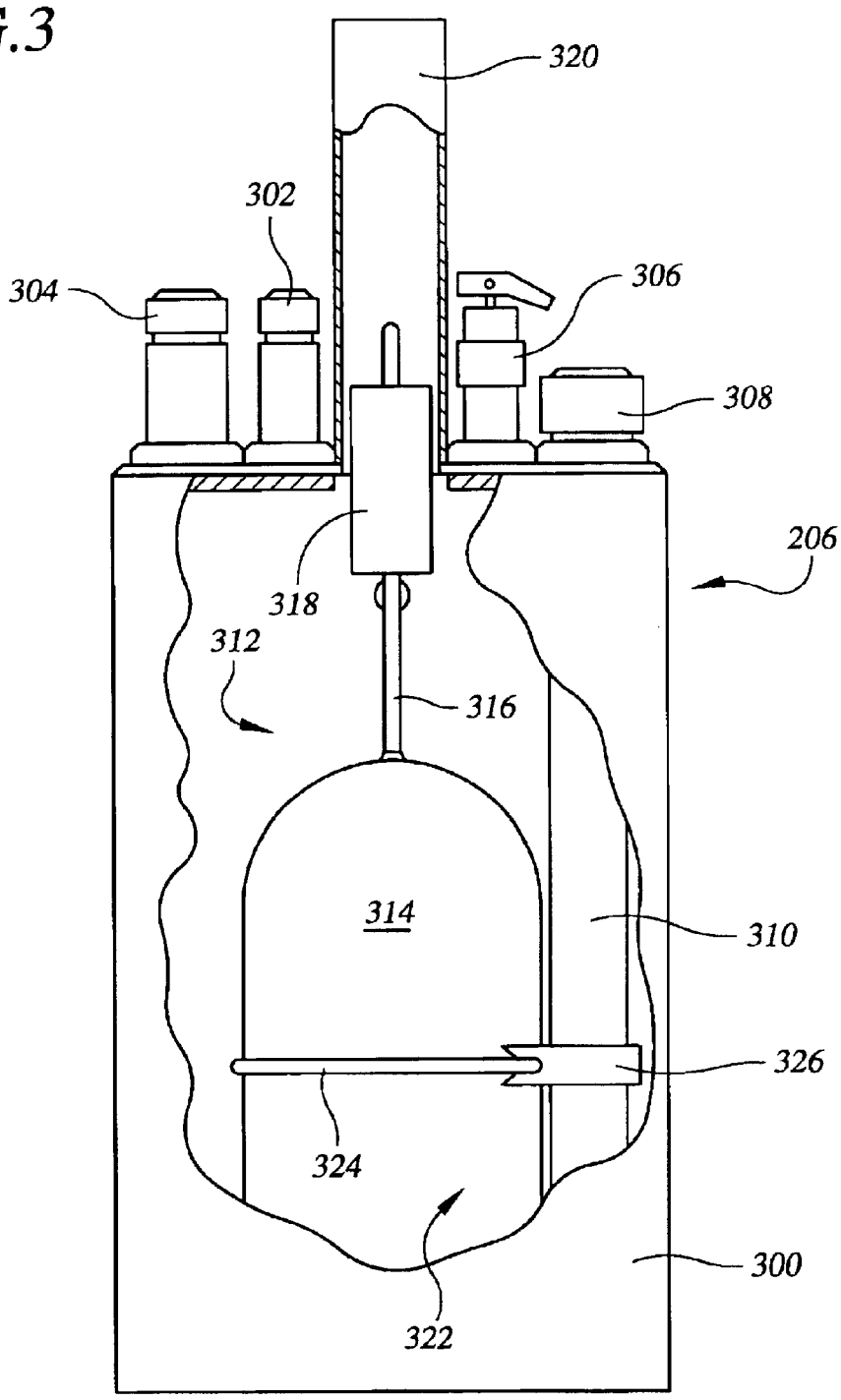
FIG. 3 is a cut-away side view of an example carbonator tank that can be used in the beverage dispensing system of FIG. 2.

FIG. 3 illustrates, in partial cut-away view, an example configuration for the carbonator tank 206 shown in FIG. 2. It is noted that alternative configurations for the carbonator tank 206, and its associated filling system, are disclosed in assignee's U.S. Pat. No. 6,253,960, which is herein incorporated by reference. As indicated in FIG. 3, the example carbonator tank 206 comprises a generally cylindrical tank 300. Mounted to the top of the tank 300 are a gas inlet port 302, a water inlet port 304, and a safety relief port 306. Further mounted to the top of the carbonator tank 206 is a carbonated water outlet 308 that is in fluid communication with the carbonated water supply line 252 (FIG. 2). Inside the carbonator tank 206 is a carbonated water supply tube 310 that extends from the bottom of the tank up to the carbonated water outlet 308 such that, when the dispenser valve 210 is activated to produce carbonated water, the pressurized carbonated water from the bottom of the carbonator tank is forced through the supply tube 310, out of the carbonated water outlet 308, through the carbonated water supply line 252, through the cold plate 242, and finally out of the dispensing valve into the beverage container C.

The carbonator tank 206 further comprises a water level indicator 312. This indicator 312 includes a hollow float member 314 having a rod 316 extending upwardly from the top portion of the float member. Positioned on the top of the rod 316 is a magnetically conductive member 318, which can be, for example, a magnetically conductive cylinder. When the carbonator tank 206 is empty, the float member 314 rests on or near the bottom of the carbonator tank. While the tank is situated in this empty configuration, part of the magnetically conductive member 318 is positioned within the tank and part is positioned within an elongated hollow tube 320 that extends upwardly from the top of the carbonator tank. This hollow tube 320 permits travel of the rod 316 and magnetically conductive member 318 in the upward direction, the purpose for which is explained below.

As the carbonator tank 206 is filled with water, the buoyancy of the float member 314 causes it to float towards the top of the tank. To maintain the float member 314, rod 316, and magnetically conductive member 318 in correct orientation, a mechanical stabilizer 322 can be provided that includes a retainer band 324 that is wrapped around the float member 314 and a slide member 326 that is disposed about the carbonated water supply tube 310. Configured in this manner, the float member 314 will continue to rise within the carbonator tank 206 as the water level within the tank increases. Similarly, the magnetically conductive member 318 will rise within the elongated hollow tube 320 so that water level sensing means can detect when the tank 206 is full, so that water flow into the tank can be halted.

Figure 5:
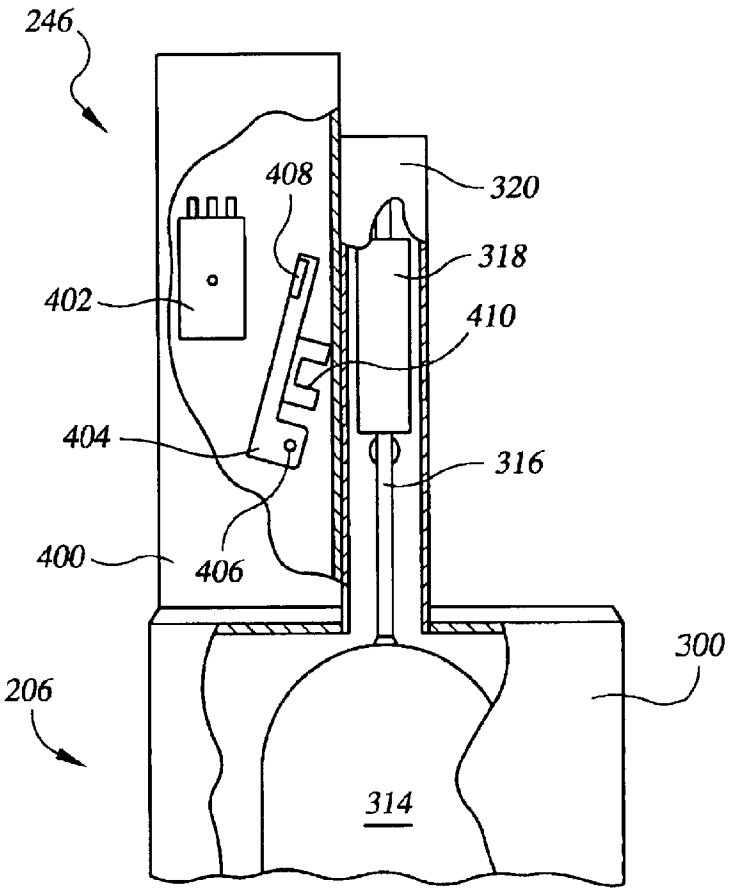
FIG. 5 is a cut-away side view of the carbonator tank of FIG. 3, shown with the pneumatic water level switch in the inactivated or full position.
Figure 4:
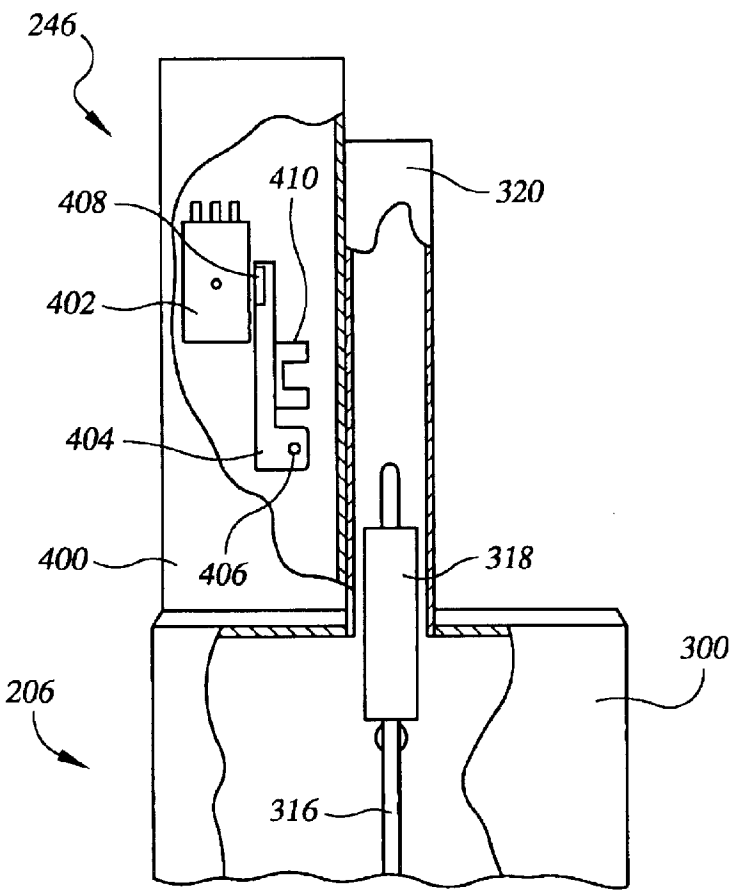
FIG. 4 is a cut-away side view of the carbonator tank of FIG. 3, shown with a pneumatic water level switch in the activated or fill position.

As described above, the water level within the tank 206 can be controlled using the filling system 246. FIGS. 4 and 5 illustrate an example configuration of one such filling system 246. As indicated in these figures, the filling system can comprise an outer housing 400 that is positioned in close proximity to the hollow 320 of the carbonator tank 206. Located within the housing 400 is a pneumatic, magnetic proximity switch 402 and a lever arm 404. Although the proximity switch 402 is fixed in position within the housing 400, the lever arm 404 is free to pivot about a pivot point 406 (e.g., a pin) such that the lever arm is pivotally mounted within the housing. Mounted to the lever arm 404 are first and second magnets 408 and 410. The first magnet 408 is mounted to the arm 404 at a position in which it is adjacent the proximity switch 402 when the lever arm is vertically oriented as shown in FIG. 4.

Because the first magnet 408 is attracted to the proximity switch 402, the first magnet maintains the lever arm 404 in a vertical orientation when the tank 206 is not full. When the lever arm 404 is in this vertical orientation, positive contact is made with the proximity switch 402, thereby activating the switch and causing it to send a pneumatic pressure signal to the water control valve 238 (FIG. 2) to remain open so that the carbonator tank 206 can be filled. As the water level rises, however, the magnetically conductive member 318 within the hollow tube 320 rises, eventually moving to a position in which it is adjacent the second magnet 410 mounted on the lever arm 404. Since the magnetically conductive member 318 is constructed of a magnetically conductive metal, such as magnetically conductive stainless steel, the second magnet 410 of the lever arm 404 is attracted to the member. In that the attractive forces between the second magnet 410 and the magnetically conductive member 318 are greater than those between the first magnet 408 and the proximity switch 402, the lever arm 404 pivots toward the magnetically conductive member as depicted in FIG. 5. By pivoting in this direction, contact between the first magnet 408 and the proximity switch 402 is interrupted, thereby deactivating the proximity switch and shutting the supply of pressurized gas to the water control valve 238, causing the normally closed valve to interrupt the flow of water to the carbonator tank 206.

Figure 6:
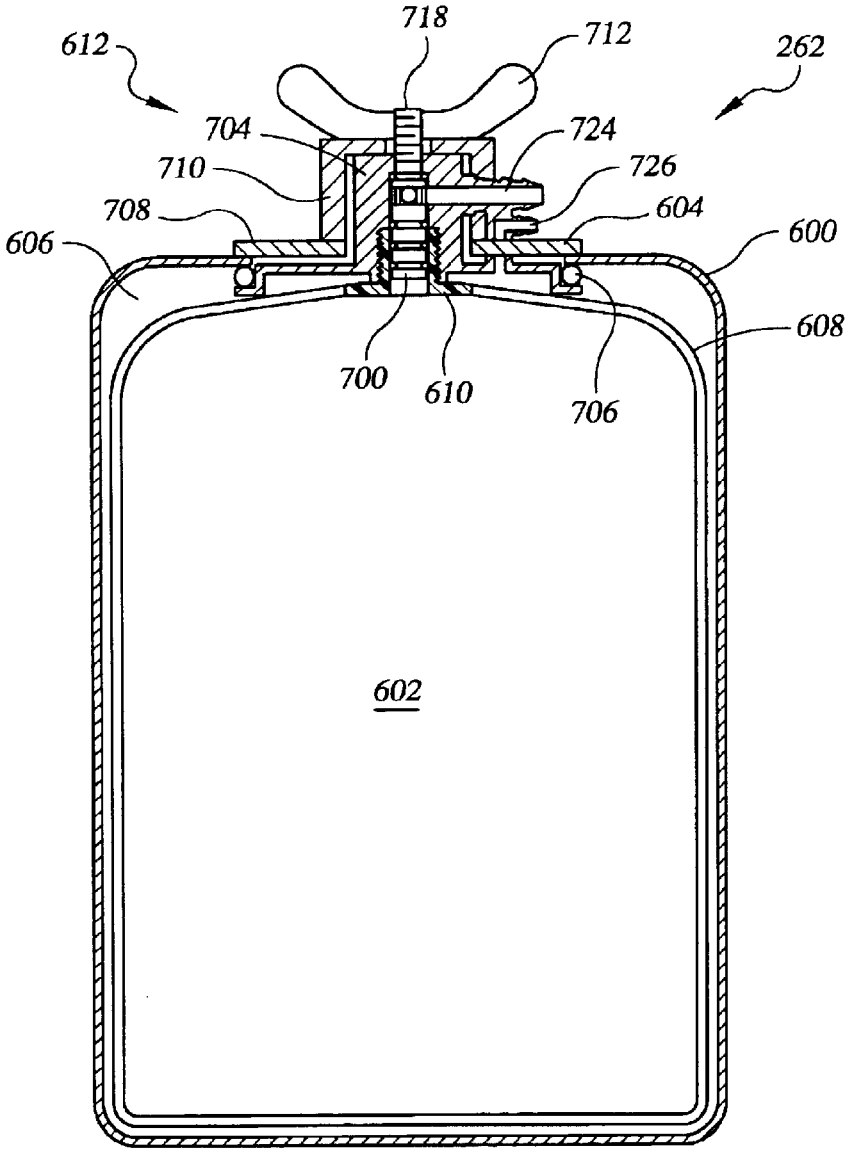
FIG. 6 is a cross-sectional side view of an example liquid container that can be used in the beverage dispensing system of FIG. 2.
Figure 8:
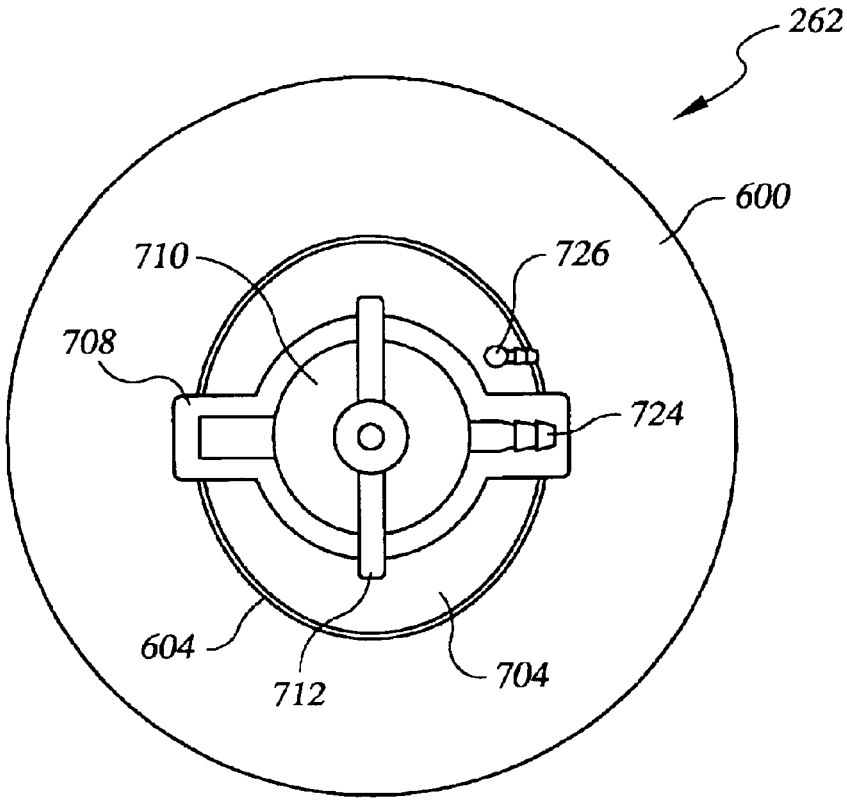
FIG. 8 is a top view of the liquid container of FIG. 6.

FIG. 6 illustrates an example configuration for the liquid containers 262 shown in FIG. 2. As shown in FIG. 6, the example container can comprise an external vessel 600 and a pliable bag 602 that is adapted to be placed inside the external vessel. Preferably, the external vessel 600 is constructed of a strong, rigid, corrosion-resistant material such as stainless steel. As indicated in FIG. 8, the external vessel 600 can, for example, be arranged as a cylinder having a generally circular cross-section. As indicated in FIG. 6, the external vessel 600 is provided with an opening 604 at its top end that, as is described below, permits the insertion of the pliable bag 602 within an interior space 606 formed by the external vessel.

The pliable bag 602 is typically constructed of a strong, flexible material such as a polymeric material. Preferably, the bag 602 is constructed of a material that can withstand extreme temperatures so that it can be used to store hot liquids such as coffee. The pliable bag 602 is typically constructed of two or more sheets of material that are sealed together along a seam 608. Positioned at one end of the bag 602 is a threaded neck portion 610 that, as indicated in FIG. 6, permits the pliable bag 602 to be threaded into an adapter 612 that is described in detail with reference to FIG. 7. Generally speaking, however, the adapter 612 permits the pliable bag 602 to be suspended within the external vessel 600 such that the bag can be used to store liquid and such that the interior space 606 can be pressurized by gas to, in turn, pressurize the liquid and provide a mechanism for driving it out of the container 262.

Figure 7:
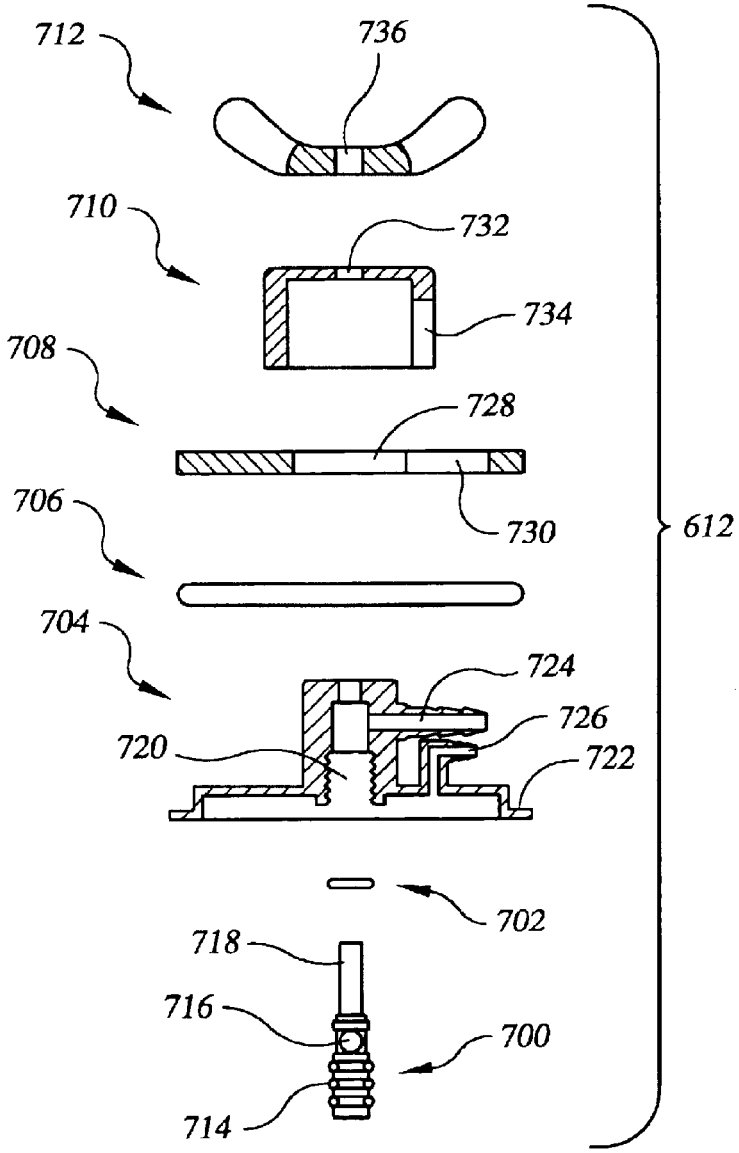
FIG. 7 is an exploded view of an adapter of the liquid container of FIG. 6.

Referring now to FIG. 7, the adapter 612 can generally comprise a liquid transfer tube 700, a first sealing member 702 (e.g., o-ring), a vessel closure 704, a second sealing member 706 (e.g., o-ring), a locking bar 708, a spacer 710, and a fastener 712 (e.g., wing nut). The liquid transfer tube 700 includes one or more of its own sealing members 714 (e.g., o-rings), an outlet 716, and a threaded portion 718. With reference back to FIG. 6, the sealing members 714 permit an air-tight seal to be established with an interior surface of the neck portion 610 of the pliable bag 602.

Returning to FIG. 7, the vessel closure 704 includes partially threaded passage 720 that is adapted to receive the threaded neck portion 610 of the pliable bag 602, and an outer lip 722 that is adapted to receive the sealing member 706. In addition, the vessel closure 704 comprises a liquid passage 724, which is adapted to deliver liquid to and from the liquid container 262, and a gas passage 726, which is adapted to deliver pressurized gas to the interior space 606 of the external vessel 600, as well as out from the vessel to the atmosphere during venting. As is most readily apparent from FIG. 8 which illustrates the liquid container 262 in a top view, the vessel closure 704, as well as the vessel opening 604, can be elliptical so as to facilitate insertion and sealing of the vessel closure and to prevent opening while the vessel is under pressure. Specifically, the vessel closure 704 can be inserted through the vessel opening 604, rotated so that the elliptical shape of the closure and the opening are matched, and then fastened into place (FIG. 6).

Continuing with FIG. 7, the locking bar 708 includes an opening 728 and a slot 730 which permit the passage of the vessel closure 704 when the adapter 612 is assembled. As indicated most clearly in FIG. 8, which depicts the closed position of the adapter 612, the locking bar 708 is generally elongated such that its length dimension is greater that the narrowest dimension of the vessel opening 604. With reference back to FIG. 7, the spacer 710 includes an opening 732 that is adapted to permit passage of the threaded portion 718 of the liquid transfer tube 700, and a slot 734 that, like the slot 730, is adapted to permit passage of the vessel closure 704.

The fastener 712 is provided with a threaded opening 736 such that the fastener can be threaded onto the threaded portion 718 of the liquid transfer tube 700.

Referring now to FIG. 6, the adapter 612 is assembled by inserting the liquid transfer tube 700 into the threaded passage 720 of the vessel closure 704 with the sealing member 702 positioned therebetween. Once the sealing member 706 is received by the outer lip 722 of the vessel closure 704, the vessel closure can be inserted through the vessel opening 604 and oriented such that the closure's elliptical shape is aligned with that of the opening. To prevent the vessel closure 702 from dropping down into the interior space 606 of the vessel 600, the locking bar 708 is placed over the vessel closure in the manner depicted in FIG. 8. Next, the spacer 710 is placed over the vessel closure 704 and the fastener 712 is threaded onto the threaded portion 718 of the liquid transfer tube 700 that extends through the opening 732 of the spacer so as to draw the vessel closure upwardly against the sealing member 706 so as to tightly seal the vessel closure in place on the vessel 600.

With reference back to FIG. 2, the beverage dispensing system 200 can be used to dispense carbonated and noncarbonated beverages. To use the system 200, the water tank 228 is filled with water via the water tank refill valve 232 and water supply line 230. Once the water tank 228 has been filled to an appropriate level and the supply coupler removed, the valve 226 is automatically switched to the gas open position such that the water in the tank is pressurized by the gas. As the gas continues to flow into the water tank 228, the water is forced out of the tank and flows through the water supply line 230 to both the carbonator tank water control valve 238 and the water pressure regulator 240. The water that passes through the water pressure regulator 240 is routed to the cold plate 242 and, if desired, dispensed through the dispensing valve 210.

Gas also flows into the carbonator tank 206, raising the pressure within the tank to, for instance, approximately between 80 psi to 125 psi. In addition, this gas is directed to the filling system 246 and is used, as needed, to send pneumatic pressure signals to the water control valve 238. Assuming the carbonator tank 206 initially does not contain water, the float member 314 contained therein is positioned near the bottom of the tank and the switch 402 in the activated position shown in FIG. 4. Because the switch 402 is in this activated position, pneumatic pressure is provided to the water control valve 238, keeping it in the open position so that water can flow into the carbonator tank 206. As the water continues to flow from the water tank 228, the pressure of the water begins to rise sharply. Eventually, the pressure of the water in the tank 228 reaches a pressure equal to that of the gas provided to the tank. Since the carbonator tank 206 is relatively small as compared to the gas storage tank 212 and the water tank 228, the carbonator tank fills quickly. Therefore, carbonated water is available soon after the system 200 is initiated. As such, the operator can use the dispensing valve 210 to dispense either flat water from line 230 or carbonated water from line 252.

Once the carbonator tank 206 is fill, the switch 402 becomes oriented in the inactivated position (FIG. 5), thereby shutting off the supply of gas to the water control valve 238. Without the pressure signal needed to remain open, the water control valve 238 closes, cutting the supply of water to the carbonator tank 206. As the water level within the carbonator tank 206 is again lowered, the switch 402 is again activated, restarting the process described above. The system 200 therefore cycles in response to the volume of water contained in the carbonator tank 206. The cycle occurs repeatedly during use of the system 200 until either the gas or water supplies are depleted. At this time, either or both may be refilled, and the system 200 reinitiated.

Occurring concurrently with the water pressurization and supply described above, the pressurization and supply of the liquid contained in the containers 262 is effected under the influence of the pressurized gas. In particular, gas travels from the supply line 254 to the valve 256. Assuming the containers 262 are not currently being refilled, the gas continues on to the gas supply line 270 and into the containers so as to pressurize the liquid contained therein. Where the containers 262 are configured in the manner illustrated in FIGS. 6–8, the gas is used to pressurize the pliable bags 602 provided within the external vessels 600. With this pressurization, liquid will flow out from the pliable bags 602 and through the liquid supply lines 272 when the appropriate controls are activated on the dispensing valve 210.

When one or more of the containers 262 are depleted (or prior to that time), they can be refilled by simply connecting the quick-release coupler 112 to its mating quick-release coupler 276 so as to facilitate the flow of liquid to the system 200. For instance, where the filling scheme is arranged as indicated in FIG. 1, liquid from one or more of the containers 100 can be provided through the supply lines 104, through the filling lines 110, and to the beverage dispensing system 200. As described above, such filling is also facilitated by the valve 256 that is automatically actuated when an external coupler is connected to the coupler 276. Specifically, when an external coupler is connected to the coupler 276, the lever 258 is depressed, thereby shutting the flow of gas to the containers 262 off and venting the gas contained within the containers to the atmosphere.

Often, the containers 262 will contain liquids that are to be used in carbonated drinks, such as soft drink syrups. Optionally, however, other liquids can be provided. For instance, hot liquids such as coffee, tea, or hot chocolate can be stored in the containers 262. In such a situation, the liquid can be simply poured into the container 262 via the appropriate liquid filling line 280 under the force of gravity as opposed to being pumped through the line.

As identified above, when the containers 262 are arranged in a self-contained, removable container unit 264, the unit can be removed from the beverage dispensing system 200, and the delivery vehicle where applicable, for servicing and/or replacement of the containers 262 or various components thereof. For example, it may be necessary to periodically replace the pliable bags 602.

Figure 9:
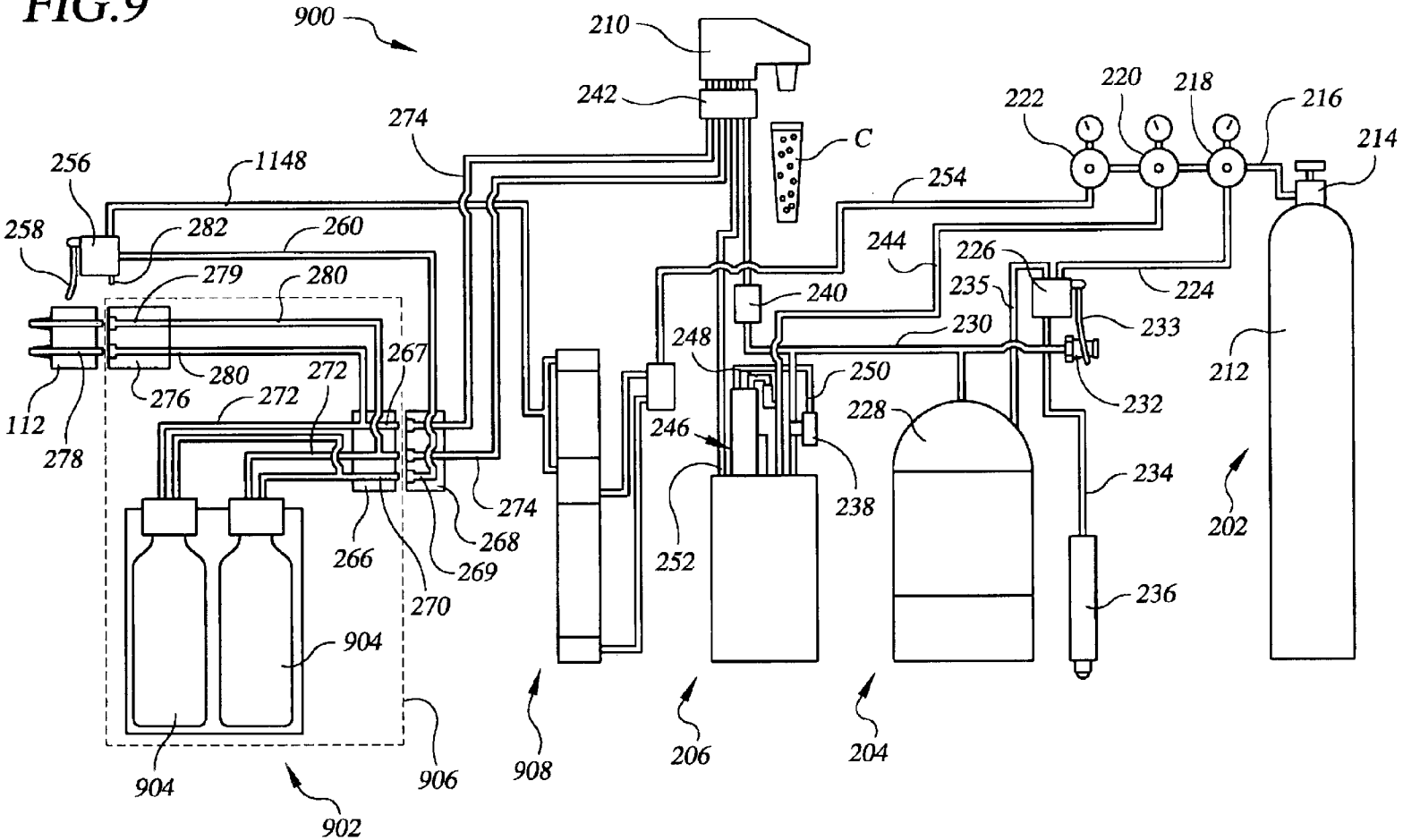
FIG. 9 is a schematic view of a second embodiment of a portable beverage dispensing system.

FIG. 9 is a schematic view of a second embodiment of a portable beverage dispensing system 900. The system 900 is similar in several respects to the system 200 shown in FIG. 2. Accordingly, the system 900 comprises a source 202 of driving gas, a source 204 of water, a carbonator tank 206, and a beverage dispensing valve 210. In addition, the system 900 comprises other like-numbered components that are the same as or similar to those described above in relation to FIG. 2. However, the beverage dispensing system 900 comprises an alternative source 902 of liquids that includes one or more alternative liquid containers 904, which are described in greater detail below in relation to FIG. 10. As indicated in FIG. 9, these containers 904 can be, as in the system 200, provided in a removable container unit 906, which facilitates removal of the containers as a cell. For reasons explained below, the system 900 further includes an air pump system 908 that provides air to the containers 904 to act as the driving mechanism.

Figure 10:
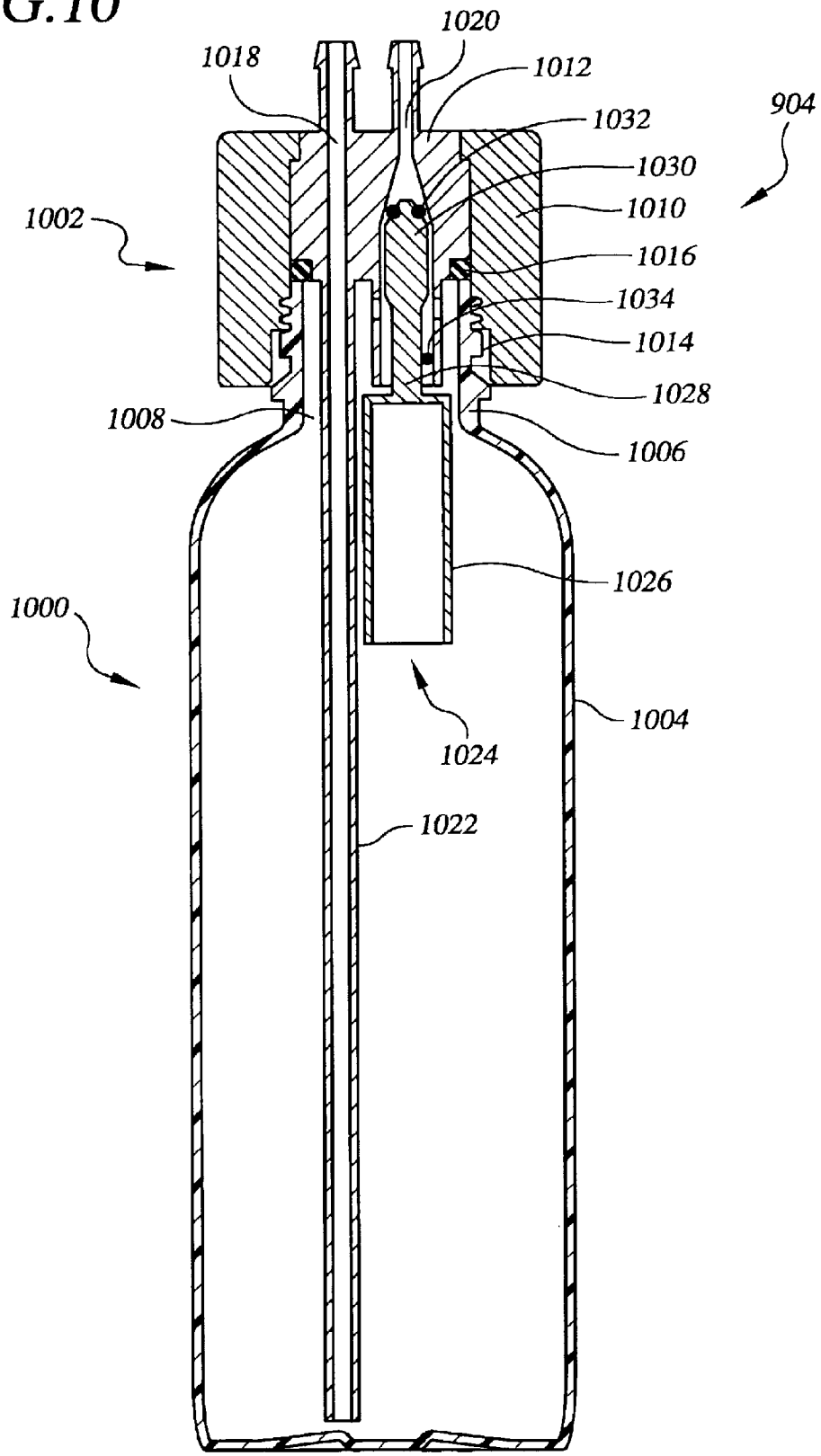
FIG. 10 is a cross-sectional side view of an example liquid container that can be used in the beverage dispensing system of FIG. 9.

FIG. 10 illustrates an example configuration for the liquid containers 904. As indicated in this figure, each liquid container 904 can comprise a bottle 1000 and a bottle coupler 1002. By way of example, the bottle 1000 can comprise a standard polymeric bottle having a body 1004 and a threaded neck 1006 that forms an opening 1008. The bottle coupler 1002 generally comprises an exterior portion 1010 and an interior portion 1012 that is disposed within an internal passageway 1014 of the exterior portion. A portion of the internal passageway 1014 is threaded such that the exterior portion 1010 can be threadingly engaged with the threaded neck 1006 of the bottle 1000. Placed between the interior portion 1012 and the exterior portion 1010 is a sealing member 1016 (e.g., o-ring) that forms an air-tight seal between the bottle 1000 and the coupler 1002.

The interior portion 1012 of the coupler 1002 includes a liquid passage 1018 and a gas passage 1020, which are adapted to direct liquid out of the bottle and gas (typically air) into the bottle, respectively. Extending down into the bottle 1002 is a supply/pick-up tube 1022 which extends the liquid passage 1018 such that liquid is only supplied to or drawn from the bottom of the bottle. Positioned in the gas passageway 1020 is a gas passage closure member 1024. As indicated in the figure, the closure member 1024 can generally comprise a body portion 1026, a neck portion 1028, and a head portion 1030. Placed at the head portion 1030 is a further sealing member 1032 (e.g., o-ring) that permits the member 1024 to form an air-tight seal with the interior of the gas passage 1012 when the member is in the closed position (as in FIG. 10).

In operation, liquid is first provided to the interior of the bottle 1000 through the liquid passage 1018 during the filling operation described above in relation to the embodiment shown in FIG. 2. During this filling, the bottle is vented to the atmosphere and no gas flows into the bottle 1000 due to the valve 256. Accordingly, the closure member 1024 drops down under the force of gravity such that the gas passage 1012 is open. The member 1024 is, however, retained within the passage 1012 due to the provision of a detent 1034 that is provided within the passage. As the level of the liquid within the bottle 1000 rises, it eventually reaches the closure member 1024 and, due to the bouyancy of the member, causes the member to rise until ultimately seating within the gas passage 1012 so as to close it. With the gas passage 1012 closed, the liquid will not be able to escape the bottle 1000 and the bottle will ultimately be filled to the point where no more liquid can be placed inside it.

Once the filling process has been completed (and the supply-side coupler, e.g., coupler 112, removed), the valve 256 closes the vent 282 and delivers pressurized gas to the container 904 via supply lines 260 and 270 that are in communication with gas passage 1012. This gas pressurizes the liquid within the bottle 1000 so that, when an appropriate control is activated on the dispensing valve 210, the liquid will be propelled along the liquid supply line 272 and delivered to the valve via the line 274.

Although a particular type of container has been described in relation to FIG. 10, it will be appreciated that alternative configurations are feasible. For instance, the container can be configured as that this disclosed in assignee's U.S. Pat. No. 6,216,913, and assignee's U.S. patent application Ser. No. 09/848,924, filed May 3, 2002, which are hereby incorporated by reference.

As noted above, the system 900 includes an air pump system 908 that is adapted to provide pressurized air to the containers 904. Air is preferable for the pressurizing of the containers 904 in that, unlike the containers 262 of the system 200, the containers 904 do not comprise means to separate the liquid stored in the container from the gas. If a gas such as $CO_2$ were placed in direct contact with the liquid stored in the containers 904, the liquid would, to one extent or another, become carbonated. This is an undesirable side-effect even for liquids that are to be used to form carbonated drinks in that it is then difficult to control the amount of carbonation that each beverage will have.

Figure 11:
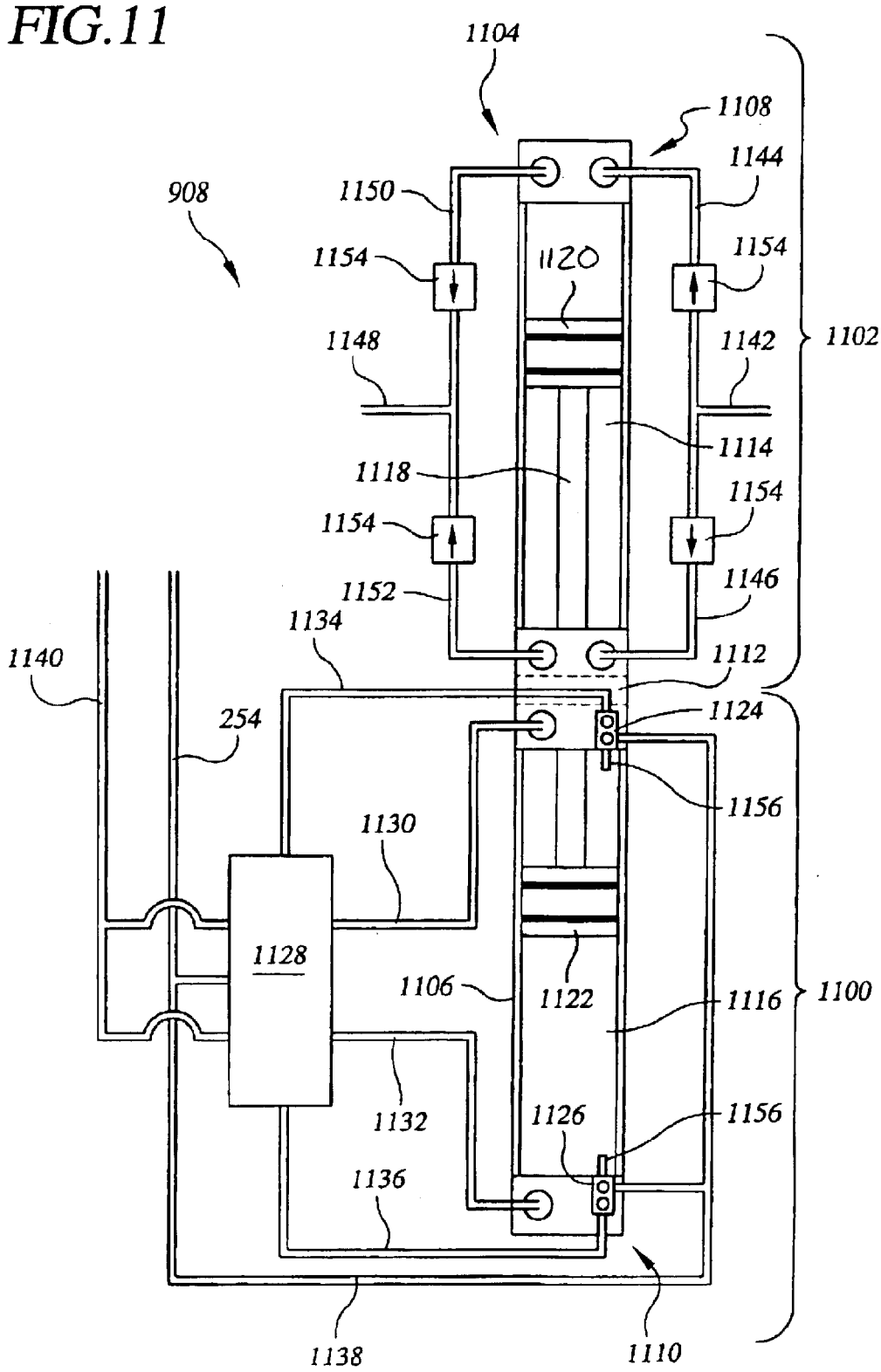
FIG. 11 is a schematic view of an air pump that can be used in the beverage dispensing system of FIG. 9.

FIG. 11 illustrates an example configuration for the air pump system 908. The pump system 908 generally comprises a gas side 1100 and an air side 1102. The pump system 908 further comprises a double acting pump 1104 that extends through both the gas side 1100 and the air side 1102 of the system. The double acting pump 1104 typically is arranged as an elongated cylinder including an outer tube 1106 having a first end 1108 and a second end 1110. Positioned intermediate the first and second ends 1108 and 1110 is a dividing member 1112 that separates the pump 1104 into a first or air, chamber 1114 and a second or gas, chamber 1116. Extending through the dividing member 1112 is a piston rod 1118. Rigidly connected to the piston rod 1118 are a first piston head 1120 and a second piston head 1122. Each of these piston heads 1120, 1122 is typically provided with at least one sealing member (e.g., o-ring) that prevents the passage of gas or air around its periphery during use. Disposed within the gas side 1100 of the pump 1104 are first and second proximity sensors 1124 and 1126 that, as is described below, send pneumatic signals to a master control valve 1128 that controls operation of the pump.

The double acting pump 1104 is provided with a plurality of pneumatic line connections schematically represented in FIG. 11. With respect to the gas side 1100, the pump 1104 is provided with first and second gas supply lines 1130 and 1132. As shown in the figure, the first gas supply line 1130 connects to the pump 1104 adjacent the dividing member 1112, and the second gas supply line 1132 connects to the pump adjacent its second end 1110. These gas supply lines 1130, 1132 extend from the pump 1104 to the master control valve 1128. Also connected to the pump 1104 on the gas side 1100 of the system 908 are first and second signal lines 1134 and 1136. The first signal line 1134 is in fluid communication with the first proximity sensor 1124 and the second signal line 1136 is in fluid communication with the second proximity sensor 1126. As with the gas supply lines 1130 and 1132, the first and second signal lines 1134 and 1136 similarly connect to the master control valve 1128. In addition to their connections to the signal lines 1134 and 1136, the proximity sensors 1124 and 1126 further are in fluid communication with a sensor gas supply line 1138. This sensor gas supply line 1138 is connected to a main gas supply line 254 shown in FIG. 9. The gas side 1100 further includes a vent line 1140 that is connected to the master control valve 1128.

With respect to the air side 1102 of the air pump system 908, the double acting pump 1104 includes an air supply line 1142 that can be, for instance, connected to an air filter (not shown). The air supply line 1142 is connected to first and second air passage lines 1144 and 1146 that connect to the pump 1104 at its first end 1108 and adjacent the dividing member 1112, respectively. The air side 1102 of the air pump system 908 further includes an air output line 1148 that is connected to two air passage lines, namely a third air passage line 1150 and a fourth air passage line 1152. Positioned intermediate each of the air passage lines is a check valve 1154 which ensures that air can pass through the lines only in a single direction (indicated with arrows).

The primary components of the air pump system 908 having been described above, operation and use of the system will now be discussed. Pressurized gas, e.g., $CO_2$, is provided to the master control valve 1128 which, in turn, either directs this gas into the first gas supply line 1130 or the second gas supply line 1132, depending upon the desired direction of travel of the second piston head 1122. For instance, if it is desired that the second piston head 1122 travel toward the dividing member 1112, the gas is supplied to the second gas supply line 1132 and, thereby, into the gas chamber 1116 adjacent the second end 1110 of the pump outer tube 1106. As this gas collects in the gas chamber 1116, its pressure urges the second piston head 1122 toward the air side 1102 (upward in FIG. 11). In that the second piston head 1122 is fixedly connected to the first piston head 1120 with the piston rod 1118, this axial displacement of the second piston head effects a similar axial displacement of the first piston head. As the first piston head 1122 travels toward the first end 1108 of the outer tube, the air in the air chamber 1114 is forced outwardly from the outer tube and into the third air passage line 1150 such that this air can travel through the check valve 1154 and into the air output line 1148, and finally into one or more of the liquid containers 904 (FIG. 9). To facilitate this movement of air, and avoid the creation of a vacuum, fresh air is provided to the air chamber 1114 behind the first piston head 1120 with the second air passage line 1146.

Once the second piston head 1120 within the gas side 1102 of the system 908 reaches a point adjacent the dividing member 1112, the piston head 1122 makes contact with the first proximity sensor 1124. In particular, the piston head depresses a valve needle 1156 of the proximity sensor 1124 to send a pneumatic signal along the first signal line 1134 to the master control valve 1128 to cause the control valve to redirect the high pressure gas supplied by the main gas supply line 254 from the second gas supply line 1132 to the first gas supply line 1130 so as to urge the second piston head 1122 in the opposite direction. As the second piston head 1122 travels toward the second end 1110 of the pump 1104, the gas in front of the piston head is evacuated through the second gas supply line 1132 (which previously had supplied high pressure gas to the gas chamber 1116). The gas evacuated in this manner through the second gas supply line 1132 is directed within the master control valve 1128 to the vent line 1132 such that this gas is evacuated out to the atmosphere. As before, travel of the second piston head 1122 effects similar travel of the first piston head 1120. Accordingly, the first piston head 1120 now travels toward the dividing member 1112. As the first piston head 1120 travels in this direction, the air within the air chamber 1114 is forced outwardly from the outer tube 1106 this time through the fourth air passage line 1152, through its check valve 1154, and finally out through the air output line 1148. While the first piston head 1120 travels in this direction, the roles of the first and second air passage lines 1144 and 1146 are reversed, i.e., the first air passage line 1144 provides fresh air to the air chamber 1114, and the second air passage line 1146 is closed by its check valve 1154.

Operating in this manner, the air pump system 908 supplies pressurized air to one or more of the containers 904 such that the liquid contained therein will be urged outwardly therefrom when this liquid is needed. In that air is supplied to these containers 904 as opposed to $CO_2$ gas, carbonation of the liquid within these containers is avoided.

While preferred embodiments of the invention have been disclosed in detail in the foregoing description and drawings, it will be understood by those skilled in the art that variations and modifications thereof can be made without departing from the spirit and scope of the invention as set forth in the claims.

What is claimed is:

1. A beverage dispensing system, comprising:

a self-contained, removable container unit, the container unit including at least one container that is adapted to store a liquid therein, the container unit further including a liquid filling line and a liquid supply line for each container of the container unit, each liquid filling line providing liquid to a container during filling and each liquid supply line delivering liquid from a container as required during beverage dispensing; and a source of gas under pressure that provides a driving mechanism for delivering liquid from the at least one liquid container of the removable container unit.

2. The system of claim 1, wherein the removable container unit further comprises a filling coupler and a supply coupler, the filling coupler adapted to facilitate substantially simultaneous filling of each container of the container unit and the supply coupler being adapted to connect the container unit to the remainder of the beverage dispensing system.

3. The system of claim 2, wherein the filling coupler and the supply coupler each have ports that are in fluid communication with the filling lines and the supply lines, respectively, of the removable container unit.

4. The system of claim 1, further comprising a gas supply valve associated with the removable container unit, the gas supply valve being configured such that a supply of gas to the at least one container is automatically shut off during filling of the at least one container and automatically resumed after filling of the at least one container is completed.

5. The system of claim 4, wherein the gas supply valve includes a lever that controls its actuation, the lever being configured such that it is depressed when a coupler of an external liquid source is connected to the removable container unit.

6. The system of claim 1, further comprising a source of water that is pressurized by the source of gas and a gas supply valve that is configured such that a supply of gas to the source of water is automatically shut off during filling of the source of water and automatically resumed after filling of the source of water is completed.

7. The system of claim 6, wherein the gas supply valve includes a lever that controls its actuation, the lever being configured such that it is depressed when a coupler of an external water source is connected to the removable container unit.

8. The system of claim 1, wherein the at least one liquid container is configured so as to separate liquid stored in the container from gas that is used to pressurize and drive the liquid.

9. The system of claim 8, wherein the at least one liquid container comprises an external vessel and a pliable bag that is adapted to be placed within the external vessel.

10. The system of claim 9, wherein the pliable bag is adapted to receive liquid and the external vessel is adapted to receive pressurized gas that pressurizes pliable bag from its exterior to thereby pressurize the liquid contained within the pliable bag.

11. The system of claim 9, the at least one container further comprises an adapter that connects the pliable bag to the external vessel, the adapter including a liquid passage through which liquid can enter and exit the pliable bag and a gas passage through which pressurized gas can enter and exit the external vessel.

12. The system of claim 11, the pliable bag includes a threaded neck with which it connects to the container adapter.

13. The system of claim 11, wherein the container adapter further comprises a vessel closure to which the pliable bag directly connects, the vessel closure being adapted to fit within and seal against the external vessel.

14. The system of claim 13, wherein the container adapter further comprises a liquid transfer tube that is disposed within the vessel closure and that is in fluid communication with the liquid passage via an outlet, and a fastener that fastens to the liquid transfer tube.

15. The system of claim 1, wherein the at least one liquid container comprises a bottle and a bottle coupler.

16. The system of claim 15, wherein the bottle coupler comprises a liquid passage through which liquid can travel into and out from the bottle and a gas passage through which pressurized air can pass into and out from the bottle.

17. The system of claim 16, wherein the bottle coupler further comprises a closure member that is disposed within the gas passage and that closes the gas passage when the bottle is substantially filled with liquid.

18. The system of claim 17, wherein in the closure member is adapted to float upwardly under the force of rising liquid within the bottle to seal the gas passage.

19. The system of claim 15, wherein the bottle coupler comprises an exterior portion and an interior portion that is disposed within an internal passageway of the exterior portion.

20. The system of claim 19, wherein the internal passageway of the exterior portion is partially threaded so as to be configured to threadingly engage the bottle.

21. The system of claim 19, wherein the interior portion includes a supply/pick-up tube that is adapted to supply liquid to and draw liquid from the bottom of the bottle.

22. A beverage dispensing system, comprising:

a self-contained container unit, the container unit including at least two containers that are adapted to store liquids and a filling coupler that is adapted to facilitate substantially simultaneous filling of the at least two containers, the filling coupler having separate ports that are in fluid communication with the at least two containers; and a source of gas under pressure that provides a driving mechanism for delivering liquid from the at least two containers of the removable container unit.

23. The system of claim 22, wherein the removable container unit further comprises a liquid filling line and a liquid supply line for each container of the container unit, each liquid filling line providing liquid to a container during filling and each liquid supply line delivering liquid from a container as required during beverage dispensing, wherein the ports of the filling coupler are in fluid communication with the filling lines.

24. The system of claim 23, wherein the removable container unit further comprises a supply coupler that is adapted to connect the container unit to the remainder of the beverage dispensing system.

25. The system of claim 24, wherein the supply coupler has ports that are in fluid communication with the supply lines of the removable container unit.

26. The system of claim 22, further comprising a gas supply valve associated with the removable container unit, the gas supply valve being configured such that a supply of gas to the at least one container is automatically shut off during filling of the at least one container and automatically resumed after filling of the at least one container is completed.

27. The system of claim 26, wherein the gas supply valve includes a lever that controls its actuation, the lever being configured such that it is depressed when a coupler of an external liquid source is connected to the removable container unit.

28. The system of claim 22, further comprising a source of water that is pressurized by the source of gas and a gas supply valve that is configured such that a supply of gas to the source of water is automatically shut off during filling of the source of water and automatically resumed after filling of the source of water is completed.

29. The system of claim 28, wherein the gas supply valve includes a lever that controls its actuation, the lever being configured such that it is depressed when a coupler of an external water source is connected to the removable container unit.

30. A self-contained, removable container unit for use in a beverage dispensing system, the container unit comprising:

at least two containers that are adapted to store a liquid;

a liquid filling line and a liquid supply line for each container, each liquid filling line being adapted to provide liquid to a container during filling and each liquid supply line being adapted to deliver liquid from a container as required during beverage dispensing;

a filling coupler adapted to facilitate substantially simultaneous filling of the at least two containers; and a supply coupler adapted to connect the container unit to the beverage dispensing system.

31. The container unit of claim 30, wherein the filling coupler and the supply coupler each have ports that are in fluid communication with the filling lines and the supply lines, respectively.

32. The container unit of claim 30, further comprising a gas supply line that is adapted to provide pressurized gas to the at least two containers.

33. The container unit of claim 32, wherein the supply coupler further comprises a gas port that is adapted to deliver pressurized gas to the gas supply line to drive fluid out from the at least two containers on demand.

34. A self-contained, removable container unit for use in a beverage dispensing system, the container unit comprising:

at least two containers that are adapted to store liquids;

a filling coupler that is adapted to facilitate substantially simultaneous filling of the at least two containers, the filling coupler having separate ports that are in fluid communication with the at least two containers; and a supply coupler that is adapted to connect the container unit to the beverage dispensing system, the supply coupler having separate ports that are adapted to deliver pressurized gas to the at least two containers and liquids from the at least two containers.

* * * * *